US009717127B1

(12) United States Patent
Yeh et al.

(10) Patent No.: US 9,717,127 B1
(45) Date of Patent: Jul. 25, 2017

(54) LED DEVICE AND DIMMING SYSTEM AND METHOD THEREOF

(71) Applicant: Lextar Electronics Corporation, Hsinchu (TW)

(72) Inventors: Chien-Nan Yeh, Kaohsiung (TW); Chun-Jong Chang, Zhubei (TW); Po-Shen Chen, Hsinchu (TW); Jhao-Cyuan Huang, New Taipei (TW); Tzu-Hao Liu, Taichung (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 15/339,961

(22) Filed: Nov. 1, 2016

(30) Foreign Application Priority Data

Jan. 11, 2016 (TW) ..... 105100709 A

(51) Int. Cl.
*H05B 33/08* (2006.01)
*F21V 23/04* (2006.01)
*F21Y 115/10* (2016.01)

(52) U.S. Cl.
CPC ..... *H05B 33/0845* (2013.01); *F21V 23/04* (2013.01); *H05B 33/0815* (2013.01); *F21Y 2115/10* (2016.08)

(58) Field of Classification Search
CPC ..... H05B 33/0845; H05B 33/0803; H05B 33/0815; H05B 33/0818; H05B 33/0857; Y02B 20/19; Y02B 20/346
USPC ..... 315/56, 291, 200 R, 297, 307, 312
See application file for complete search history.

(56) References Cited

U.S. PATENT DOCUMENTS 7,123,220 B2 * 10/2006 Hanari ..... G09G 3/3233 345/77
7,258,463 B2 * 8/2007 Sloan ..... H05B 33/0803 362/227
9,326,343 B2 * 4/2016 Yan ..... H05B 33/0845
2008/0143272 A1 6/2008 Byrne et al.

FOREIGN PATENT DOCUMENTS

CN 2823795 Y 10/2006
TW 356333 4/1999
TW 200900625 A 1/2009

* cited by examiner

*Primary Examiner* — Haissa Philogene
(74) *Attorney, Agent, or Firm* — McClure, Qualey & Rodack, LLP

(57) ABSTRACT

A dimming system includes a signal generating circuit, a first dimming circuit and a second dimming circuit. The signal generating circuit generates the driving signal according to the input signal, and switches the driving signal between multiple states according to the switch signal. The first dimming circuit generates the dimming signal to adjust the luminance of the LED device according to the driving signal. When the driving signal is switched from the first states to the second states, the dimming signal is changed by the first dimming circuit so that the luminance of the LED device is adjusted from the first luminance to the second luminance. The second dimming circuit adjusts the input signal according to the control signal so that the dimming signal is adjusted and the luminance of the LED device is between the first luminance and minimum luminance, or between the second luminance and minimum luminance.

25 Claims, 7 Drawing Sheets

LED DEVICE AND DIMMING SYSTEM AND METHOD THEREOF

This application claims the benefit of Taiwan application Serial No. 105100709, filed Jan. 11, 2016, the subject matter of which is incorporated herein by reference.

BACKGROUND OF THE INVENTION

Field of the Invention

The invention relates in general to a light emitting diode (LED) device and a dimming system and method thereof.

Description of the Related Art

The conventional light emitting device usually adjusts the luminance of a light source using a luminance-adjusting switch, such as a chain-type switch. For example, the conventional light emitting device includes multiple light bulbs, and the user may adjust the luminance of the light source by switching the on/off state of the multiple light bulbs. However, such dimming method may leads to the uneven distribution of the light source. Also, the adjustment of luminance is fixed. In another dimming method, the luminance of the light source is gradually adjusted using a rotation switch. Most of the conventional light emitting devices use light bulbs as the light source. However, it has become a current trend to replace the conventional light bulbs with the light emitting diodes (LEDs) as the light source. Therefore, how to adjust the luminance of LEDs under the current architecture of the lamp base design has become a prominent task for the industries. Thus, the industries need to provide a new dimming system and method to adjust the luminance of LEDs.

SUMMARY OF THE INVENTION

According to an embodiment of the present disclosure, a dimming system configured to controlling the luminance of the LED device is provided. The dimming system includes a signal generating circuit, a first dimming circuit and a second dimming circuit. The signal generating circuit generates a driving signal according to an input signal, and switches the driving signal among multiple states according to the switch signal. The first dimming circuit generates a dimming signal according to the driving signal for adjusting the luminance of the LED device. When the driving signal switches from a first state to a second state of the plurality of states, the first dimming circuit correspondingly changes the dimming signal, such that the luminance of the LED device is adjusted from a first luminance level to a second luminance level. The second dimming circuit adjusts the input signal according to a control signal, such that the dimming signal is adjusted correspondingly and the luminance of the LED device is between the first luminance level and a minimum luminance level or between the second luminance level and the minimum luminance level.

According to another embodiment of the present disclosure, a light emitting diode (LED) device is provided. The LED device includes a lamp base, at least one LED, a dimming system and a luminance-adjusting switch. The LED is disposed on the lamp base. The dimming system is electrically coupled to the LED for controlling the luminance of the LED. The luminance-adjusting switch is electrically coupled to the dimming system and the lamp base for actuating and inputting a switch signal to the dimming system, such that the dimming system may switch among multiple states to adjust the luminance of the LED. The dimming system includes a signal generating circuit, a first dimming circuit and a second dimming circuit. The signal generating circuit generates a driving signal according to an input signal, and switches the driving signal among multiple states according to the switch signal. The first dimming circuit generates a dimming signal according to the driving signal for adjusting the luminance of the LED device. When the driving signal switches from a first state to a second state of the plurality of states, the first dimming circuit correspondingly changes the dimming signal, such that the luminance of the LED device is adjusted from a first luminance level to a second luminance level. The second dimming circuit adjusts the input signal according to a control signal, such that the dimming signal is adjusted correspondingly and the luminance of the LED device is between the first luminance level and a minimum luminance level or between the second luminance level and the minimum luminance level.

According to an alternate embodiment of the present disclosure, a dimming method is provided. The dimming method includes following steps. Firstly, an input signal is generated according to a control signal. Then, a driving signal is generated according to an input signal, wherein the driving signal is switched among multiple states according to a switch signal. Lastly, a dimming signal is generated according to the driving signal for adjusting the luminance of the LED. When the driving signal switches from a first state to a second state of the plurality of states, the dimming signal correspondingly changes, such that the luminance of the LED device is adjusted from a first luminance level to a second luminance level. The dimming signal is further adjusted when the input signal is adjusted according to the control signal, such that the luminance of the LED device is between the first luminance level and a minimum luminance level or between the second luminance level and the minimum luminance level.

The above and other aspects of the invention will become better understood with regard to the following detailed description of the preferred but non-limiting embodiment (s). The following description is made with reference to the accompanying drawings.

DETAILED DESCRIPTION OF THE INVENTION

Figure 1:
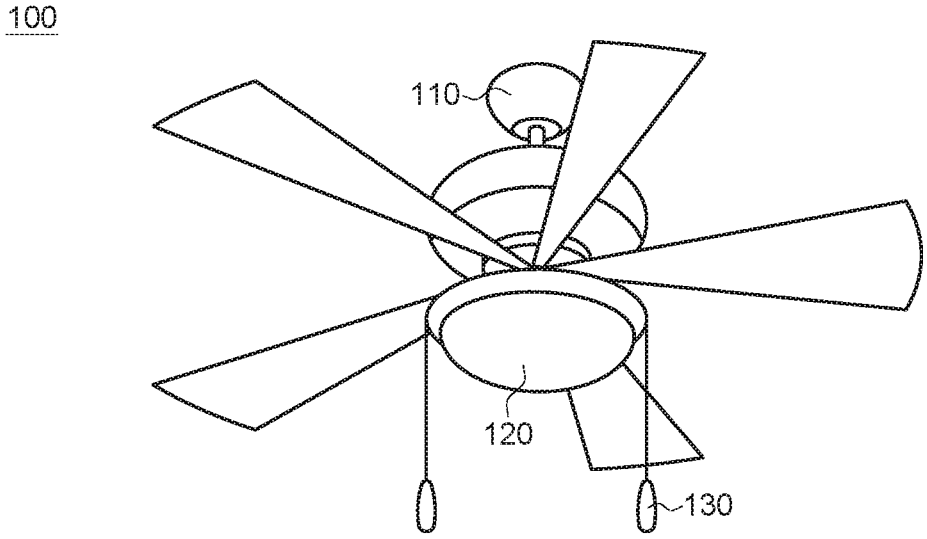
FIG. 1 is a schematic diagram of an LED device according to an embodiment of the present disclosure.

FIG. 1 is a schematic diagram of an LED device 100 according to an embodiment of the present disclosure. As indicated in FIG. 1, the LED device 100 includes a lamp base 110, a light bulb 120, and a luminance-adjusting switch 130. The light bulb 120 is disposed on the lamp base 110 and generates a light source using at least one LED. The LED device 100 further includes a dimming system (not illustrated in FIG. 1) electrically coupled to the LED for controlling the luminance of the LED. The luminance-adjusting switch 130 is electrically coupled to the dimming system and the lamp base 110 for actuating and inputting a switch signal to the dimming system, such that the dimming system may switch among multiple states to adjust the luminance of the LED. In the present embodiment, the luminance-adjusting switch 130 may be realized by such as a chain-type switch or a multi-stage key switch (composed of multiple keys respectively corresponding to different luminance levels), and has multi-stage switch states. The user may switch the LED device 100 among multiple luminance levels using the chain-type switch. In the present embodiment, the LED device 100 is exemplified by a ceiling lamp, but the present disclosure is not limited thereto. In the present disclosure, any types of LED device will do as long as the LED device has a multi-stage luminance-adjusting switch. For example, the LED device may be realized by such as a table lamp, a floor lamp, a wall lamp, a crystal chandelier or other kinds of lamps.

Figure 2:
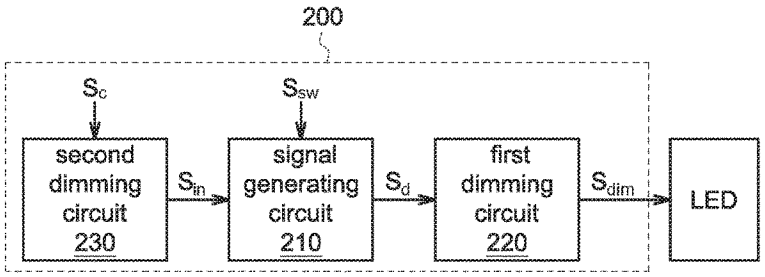
FIG. 2 is a block diagram of a dimming system according to an embodiment of the present disclosure.

To put it in greater details, the present disclosure provides a dimming system for controlling the luminance of the LED device 100. Referring to FIG. 2, a block diagram of a dimming system 200 according to an embodiment of the present disclosure is shown. The dimming system 200 includes a signal generating circuit 210, a first dimming circuit 220 and a second dimming circuit 230. In the present embodiment, the signal generating circuit 210 generates a driving signal $S_d$ according to an input signal $S_{in}$, and switches the driving signal $S_d$ among multiple states according to a switch signal $S_{sw}$ outputted from the luminance-adjusting switch 130. That is, the signal generating circuit 210 may generate different driving signals corresponding to multiple luminance levels. The first dimming circuit 220 generates a dimming signal $S_{dim}$ according to the driving signal $S_d$, wherein the dimming signal $S_{dim}$ is provided to at least one LED for adjusting the luminance of the LED device 100. The first dimming circuit 220 may be realized by such as an LED control IC. The LED control IC generates a dimming signal $S_{dim}$, such as a control voltage or control current, directly proportional to the luminance of the LED device 100. For example, a voltage level of the dimming signal is directly proportional to the luminance of the LED device. In another embodiment, the dimming signal $S_{dim}$ may be inversely proportional to the luminance of the LED device 100. For example, a voltage level of the dimming signal is inversely proportional to the luminance of the LED device. When the user switches the luminance-adjusting switch 130 to output the switch signal $S_{sw}$, the driving signal $S_d$ switches from a first state to a second state of multiple states, and the first dimming circuit 220 correspondingly changes the dimming signal $S_{dim}$, such that the luminance of the LED device 100 is adjusted from a first luminance level to a second luminance level. The second dimming circuit 230 adjusts the input signal $S_{in}$ according to a control signal $S_c$, such that the dimming signal $S_{dim}$ is adjusted correspondingly and the luminance of the LED device 100 is between the first luminance level and a minimum luminance level or between the second luminance level and the minimum luminance level. The control signal $S_c$ may be outputted from a remote controller or a rotation switch. The user may input the control signal $S_c$ using a switch with luminance adjusting function to adjust the luminance of the LED device 100 by gradually increasing or decreasing the luminance of the LED device 100. The switch with luminance adjusting function may be realized by such as a remote controller or a rotation switch. That is, apart from receiving the switch signal $S_{sw}$ outputted from the luminance-adjusting switch 130 to switch the luminance of the LED device 100 from the first luminance level to the second luminance level, the dimming system of the present disclosure may further receive the control signal $S_c$ outputted from a remote controller or a rotation switch to fine-tune the luminance of the LED device 100 between the first luminance level and the minimum luminance level or between the second luminance level and the minimum luminance level.

Figure 3:
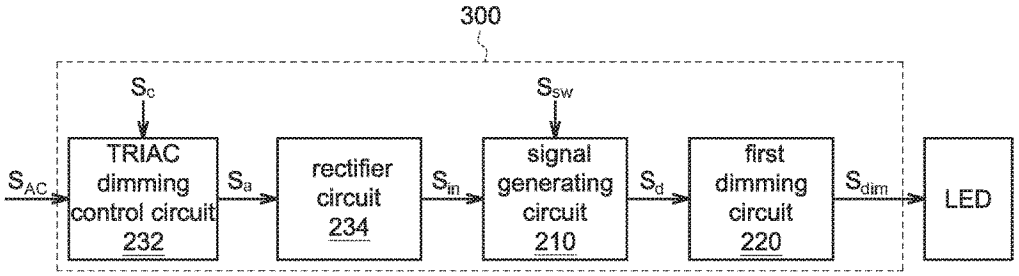
FIG. 3 is a block diagram of a dimming system according to another embodiment of the present disclosure.
Figure 4A:
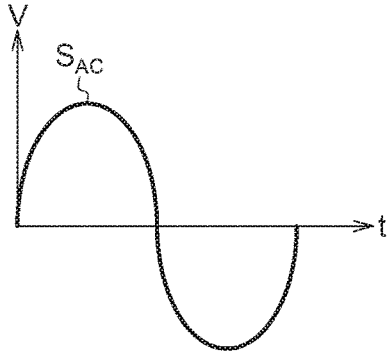
FIGS. 4A, 4B and 4C respectively are wave-patterns of an AC signal $S_{AC}$, an adjustment AC signal $S_a$ and an input signal $S_{in}$ of the present disclosure.
Figure 4B:
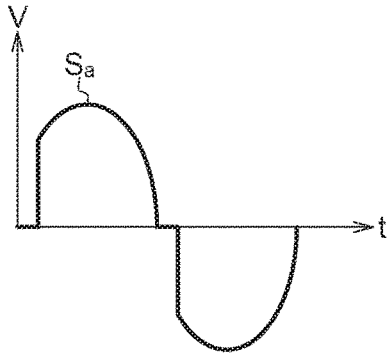
Figure 4C:
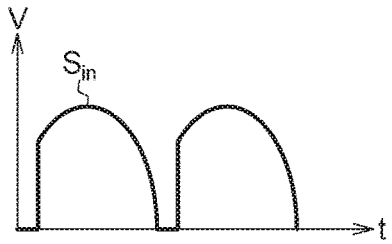

FIG. 3 is a block diagram of a dimming system 300 according to another embodiment of the present disclosure. The dimming system 300 is different from the dimming system 200 in that: the second dimming circuit 230 of the dimming system 300 further includes a triode alternating current (TRIAC) dimming control circuit 232 and a rectifier circuit 234. Referring to FIGS. 4A, 4B and 4C, wave-patterns of an AC signal $S_{AC}$, an adjustment AC signal $S_a$ and an input signal $S_{in}$ of the present disclosure are respectively shown. The TRIAC dimming control circuit 232 generates an adjustment AC signal $S_a$ according to an AC signal $S_{AC}$. As indicated in FIGS. 4A and 4B, the TRIAC dimming control circuit 232 may truncate the phase of the AC signal $S_{AC}$. For example, the TRIAC dimming control circuit 232 receives a control signal $S_c$ outputted from a remote controller or a rotation switch and truncates a part of the AC signal $S_{AC}$ to generate an adjustment AC signal $S_a$. The user may adjust the luminance of the LED device 100 using a remote controller or a rotation switch. For example, the TRIAC dimming control circuit 232 may truncate off 10% of the area of the AC signal $S_{AC}$ to decrease the luminance of the LED device 100 by 10%. Thus, the luminance of the LED device 100 may be adjusted between 100% of luminance and a minimum luminance level (such as 5% or 1% of luminance). The rectifier circuit 234 may be realized by a bridge rectifier, which rectifies the adjustment AC signal $S_a$ to generate an input signal $S_{in}$ as indicated in FIG. 4C.

Figure 5:
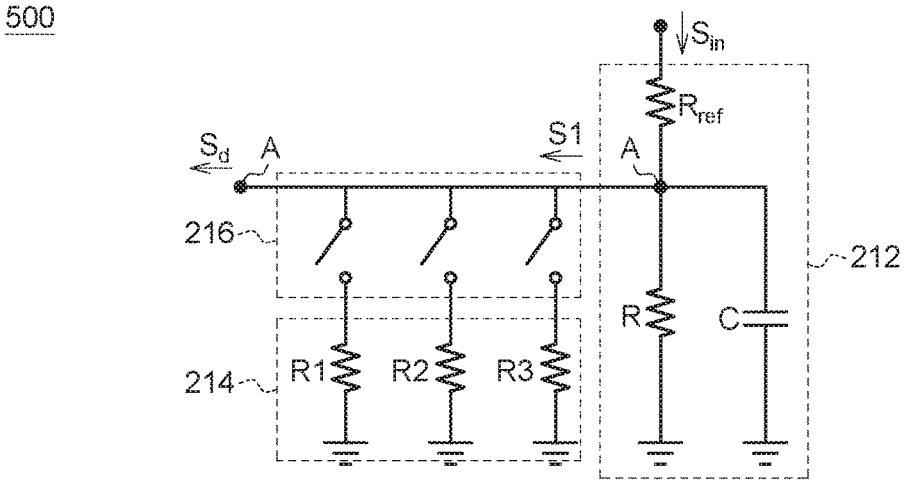
FIG. 5 is a circuit diagram of a signal generating circuit according to an embodiment of the present disclosure.

Then, the signal generating circuit 210 generates a driving signal $S_d$ according to the input signal $S_{in}$. FIG. 5 is a circuit diagram of a signal generating circuit 500 according to an embodiment of the present disclosure. As indicated in FIG. 5, the signal generating circuit 500 includes a filter circuit 212, a voltage generating circuit 214 and a multi-stage switch circuit 216. In the present embodiment, the filter circuit 212 includes a resistor $R_{ref}$, a resistor R and a capacitor C. The filter circuit 212 generates a signal S1 at node A according to the input signal $S_{in}$. The voltage generating circuit 214 includes resistors R1, R2 and R3. The resistances of the resistors R1, R2 and R3 are different. After the resistors R1, R2 and R3 are conducted with the node A, the resistors R1, R2 and R3 may provide different driving voltage levels according to the signal S1. The multi-stage switch circuit 216 includes multiple switches respectively coupled to multiple resistors. For example, the multi-stage switch circuit of FIG. 5 includes three switches respectively coupled to the resistors R1, R2 and R3 to receive a switch signal $S_{sw}$ and switch among multiple states to provide the driving signal $S_d$ corresponding to one of the multiple states. For example, the multi-stage switch circuit 216 may select a state according to the switch signal $S_{sw}$ received from the luminance-adjusting switch 130. The design may be exemplified as follows: in the first state, the resistor R1 is conducted; in the second state, the resistor R2 is conducted;

in the third state, the resistor R3 is conducted. To put it in greater details, the settings of the design may be exemplified as follows. When the switch signal $S_{sw}$ selects the first state, that is, when the resistor R1 is conducted, a driving signal $S_d$ with a first level is provided, such that the luminance of the LED device 100 reaches the first luminance level (such as 100%). When the switch signal $S_{sw}$ selects the second state, that is, when the resistor R2 is conducted, a driving signal $S_d$ with a second level is provided, such that the luminance of the LED device 100 reaches the second luminance level (such as 80%). When the switch signal $S_{sw}$ selects the third state, that is, when the resistor R3 is conducted, a driving signal $S_d$ with a third level is provided, such that the luminance of the LED device 100 reaches the third luminance level (such as 50%). The driving signals $S_d$ of multiple states correspond to multiple luminance levels of the LED device 100 respectively. Thus, the multi-stage switch circuit may be designed to have multiple states luminance allowing the luminance of the LED device to be adjusted among multiple luminance levels, such as 100%, 80%, 60%, 50%, 30%, 10% and 5%.

In another embodiment, the settings of the design may be exemplified as follows: in the first state, the resistors R1 and R2 are conducted; in the second state, the resistors R2 and R3 are conducted; in the third state, the resistors R3 and R1 are conducted, in the fourth state, the resistors R1, R2 and R3 are conducted. However, the present disclosure is not limited thereto. For example, the circuit design may be adjusted to fit actual needs, and multiple states corresponding to multiple different driving voltage levels may be provided in various switching methods. Thus, the voltage generating circuit 214 may include more resistors or other circuit elements to provide multiple different driving voltage levels, and the multi-stage switch circuit 216 may include more switches coupled to the voltage generating circuit 214. Or, the multi-stage switch circuit 216 may be realized by a multiplexer, which selects a state according to the switch signal $S_{sw}$. That is, the circuit structures of the filter circuit 212, the voltage generating circuit 214 and the multi-stage switch circuit 216 are not restricted in the present disclosure.

Figure 6:
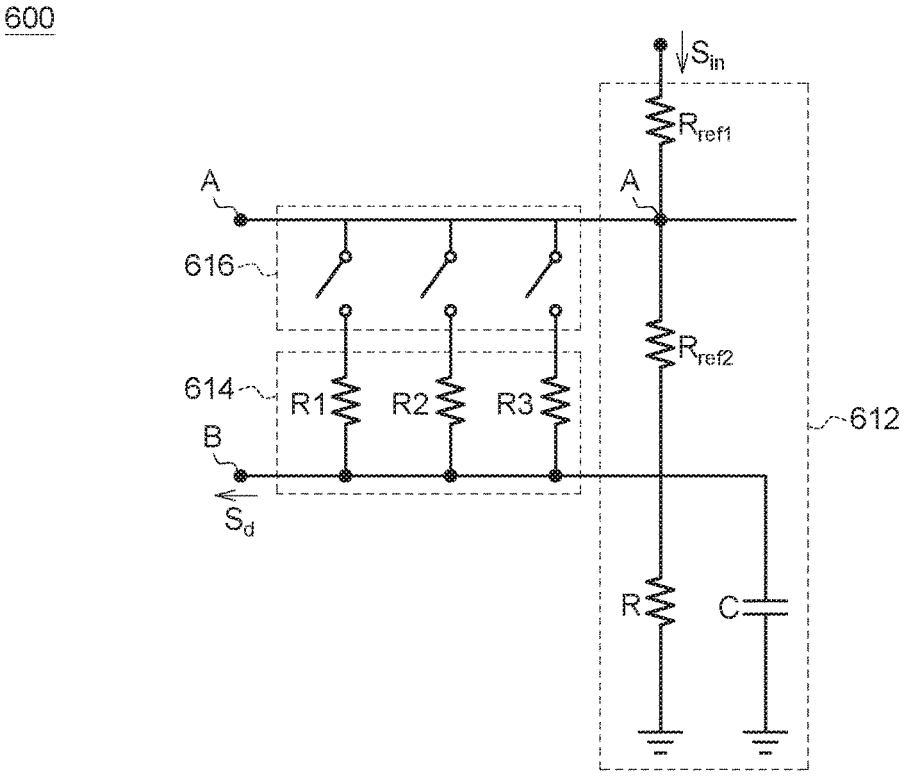
FIG. 6 is a circuit diagram of a signal generating circuit according to another embodiment of the present disclosure.

FIG. 6 is a circuit diagram of a signal generating circuit 600 according to another embodiment of the present disclosure. As indicated in FIG. 6, the signal generating circuit 600 includes a filter circuit 612, a voltage generating circuit 614 and a multi-stage switch circuit 616. In the present embodiment, functions of the filter circuit 612, the voltage generating circuit 614 and the multi-stage switch circuit 616 are the same with the filter circuit 212, the voltage generating circuit 214 and the multi-stage switch circuit 216 of FIG. 5 but the circuit structures of the filter circuit 612, the voltage generating circuit 614 and the multi-stage switch circuit 616 are different from that of the filter circuit 212, the voltage generating circuit 214 and the multi-stage switch circuit 216. The filter circuit 612 includes a resistor $R_{ref1}$, a resistor $R_{ref2}$, a resistor R and a capacitor C. Similarly, the filter circuit 612 generates a signal S1 at node A according to the input signal $S_{in}$. Likewise, the voltage generating circuit 614 provides different driving voltage levels at node B according to the signal S1. The multi-stage switch circuit 616 receives a switch signal and switches among multiple states to provide a driving signal $S_d$ corresponding to one of the multiple states. Likewise, the present disclosure is not limited thereto. For example, the circuit design may be adjusted to fit actual needs, and multiple states corresponding to various driving voltage levels may be provided in various switching methods.

Besides, when the driving signal $S_d$ is in the first state (such as corresponds to a luminance level of 100%), the TRIAC dimming control circuit 232 selectively adjusts the adjustment AC signal $S_a$ according to a control signal $S_c$, such that the luminance of the LED device 100 is between the first luminance level and a minimum luminance level. For example, the user may further adjust the control signal $S_c$ using a remote controller or a rotation switch, such that the luminance of the LED device 100 gradually decreases from 100% to 5% of luminance or gradually increases from 5% to 100% of luminance. When the driving signal $S_d$ is in the second state (such as corresponds to a luminance level of 80%), the TRIAC dimming control circuit 232 selectively adjusts the adjustment AC signal $S_a$ according to the control signal $S_c$, such that the luminance of the LED device 100 is between the second luminance level and the minimum luminance level. For example, the user may further adjust the control signal $S_c$ using a remote controller or a rotation switch, such that the luminance of the LED device 100 gradually decreases from 80% to 5% of luminance or increases from 5% to 80% of luminance. The minimum luminance level is determined according to the TRIAC minimum conduction angle of the TRIAC dimming control circuit 232.

Thus, the dimming system of the present disclosure may switch among multiple states corresponding to multiple luminance levels, and may further perform fine-tuning between the corresponding luminance level and the minimum luminance level using a remote controller or a rotation switch. Thus, the user may conveniently adjust the luminance of the light source to generate a uniform luminance without turning off part of the light bulbs or LEDs.

Figure 7A:
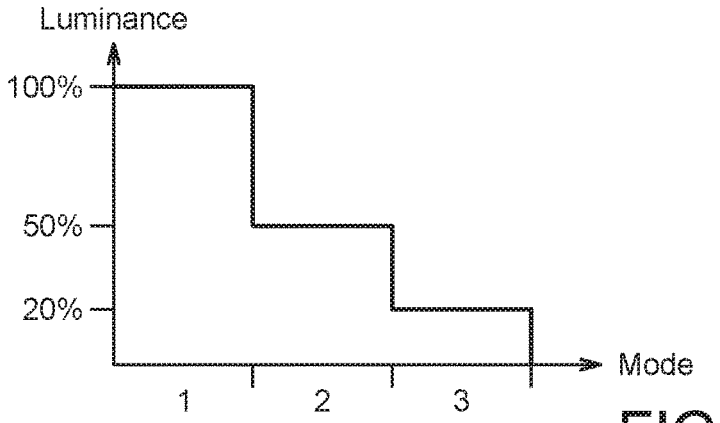
FIGS. 7A-7E luminance adjusting diagrams of the dimming system of the present disclosure.
Figure 7B:
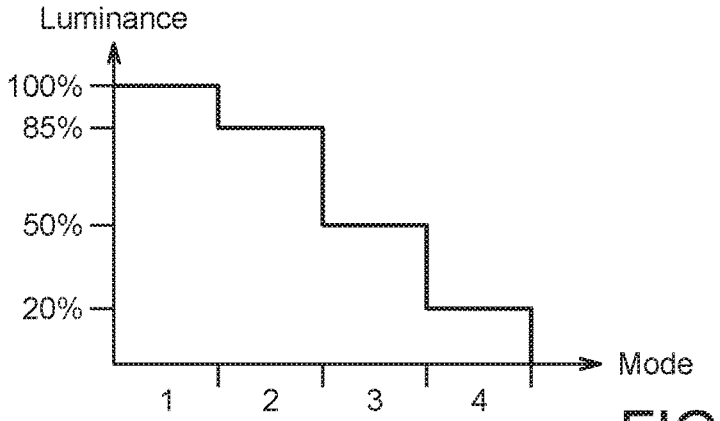
Figure 7C:
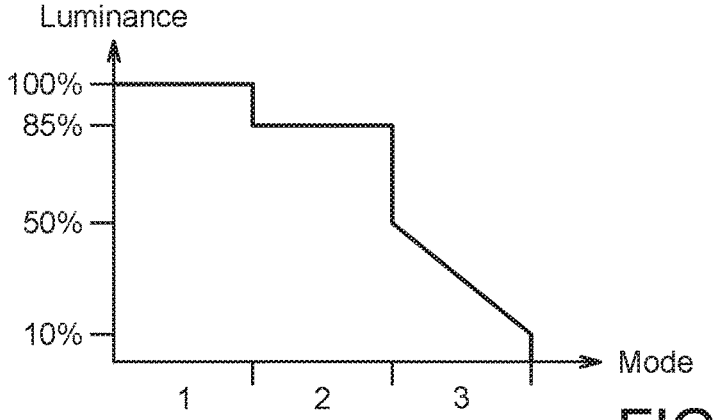
Figure 7D:
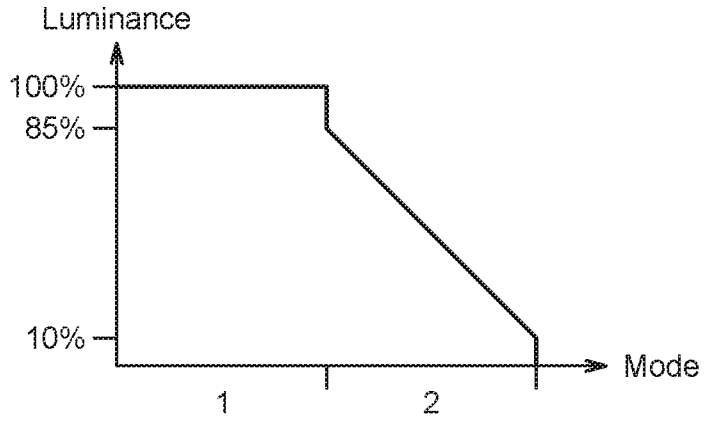
Figure 7E:
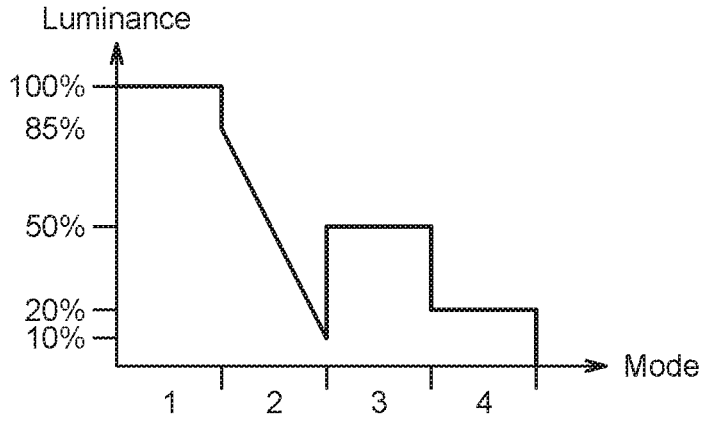

The design of multiple luminance modes of the dimming system of the present disclosure is described using a number of examples disclosed below. FIGS. 7A-7E are luminance adjusting diagrams of the dimming system of the present disclosure. As indicated in FIG. 7A, the dimming system includes three luminance modes respectively corresponding to 100%, 50% and 20%, and the user may switch among the three luminance modes using the luminance-adjusting switch 130. As indicated in FIG. 7B, the dimming system includes four luminance modes respectively corresponding to 100%, 85%, 50% and 20%, and the user may switch among the four luminance modes using the luminance-adjusting switch 130. FIG. 7C to FIG. 7E are luminance adjusting diagrams of the luminance of the LED device being adjusted under different luminance modes and minimum luminance levels using a remote controller or a rotation switch. As indicated in FIG. 7C, the first luminance mode, the second luminance mode and the third luminance mode of the dimming system correspond to 100%, 85% and 50%, respectively. Suppose the minimum luminance level of the dimming system is set at 10%. After the luminance-adjusting switch 130 switches to the third luminance mode corresponding to the luminance level of 50%, the dimming system may further adjust the luminance of the LED device between 50% and 10% using a remote controller or a rotation switch. Also, as indicated in FIG. 7D, the first luminance mode and the second luminance mode of the dimming system respectively correspond to 100% and 85%. After the luminance-adjusting switch 130 switches to the second luminance mode corresponding to the luminance level of 85%, the dimming system may further adjust the luminance of the LED device between 85% and 10% using a remote controller or a rotation switch. In another example as indicated in FIG. 7E, the dimming system includes four luminance modes corresponding to 100%, 85%, 50% and 20%, respectively. After the luminance-adjusting switch 130 switches to the second luminance mode corresponding to the luminance level of 85%, the dimming system may further adjust the luminance of the LED device between 85% and 10% using a remote controller or a rotation switch. After the luminance is adjusted using a remote controller or a rotation switch, the user may further use the luminance-adjusting switch 130 to switch the luminance mode to the third luminance mode from the second luminance mode.

It should be noted that the light adjusting diagrams of FIGS. 7A-7E of the present disclosure only schematically illustrate the luminance mode of the dimming system, and the diagrams do not indicate the sequence of switching or adjustment. For example, the user may switch the luminance mode to the second luminance mode from the first luminance mode, or switch the luminance mode to the third luminance mode from the first luminance mode, or switch the luminance mode to the first luminance mode from the fourth luminance mode. That is, the user may freely switch the luminance mode. Although the luminance illustrated in FIGS. 7C-7E is between 85% (or 50%) and 10%, the exemplifications in FIGS. 7C-7E do not imply that the luminance is only adjusted to 10% from 85% (or 50%). After the user switches the luminance mode to a particular luminance mode, the user may further perform fine-tuning on the luminance of the LED device using a remote controller or a rotation switch, such that the luminance is between a luminance level of the particular luminance mode and a minimum luminance level. However, the dimming system of the present disclosure is not limited to the exemplifications in FIGS. 7A-7E. Various luminance modes may be designed to fit actual needs, such that the user may adjust the luminance of the LED device conveniently. Moreover, the minimum luminance level is not limited to 10%. For example, the minimum luminance level may be set at such as 5% or 1%, and the minimum luminance level may be determined according to the TRIAC minimum conduction angle of the TRIAC dimming control circuit.

Figure 8:
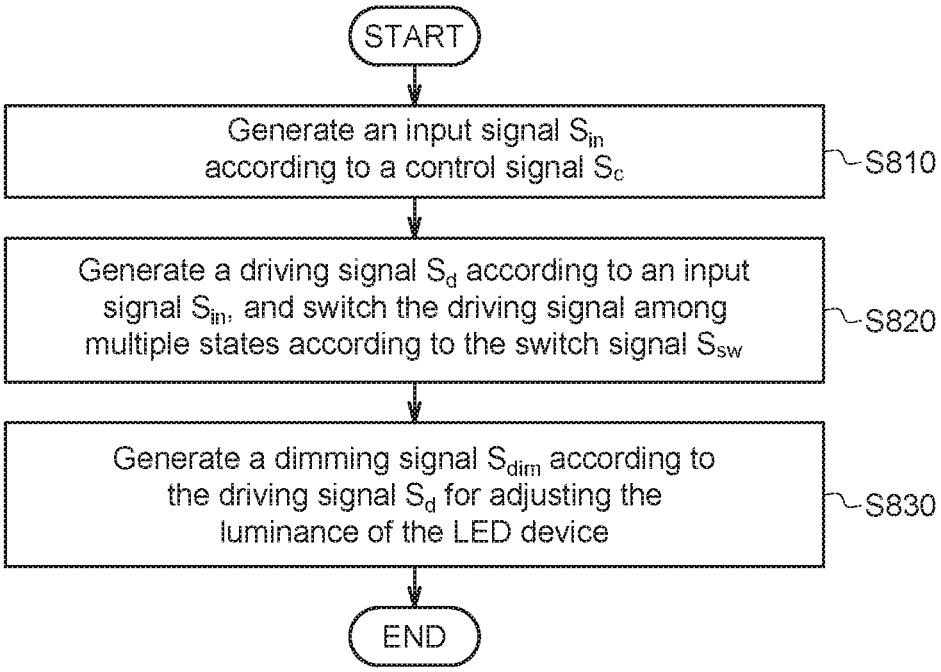
FIG. 8 is flowchart of a dimming method according to an embodiment of the present disclosure.

FIG. 8 is a flowchart of a dimming method according to an embodiment of the present disclosure. The dimming method includes following steps. Firstly, in step S810, an input signal $S_{in}$, is generated according to a control signal $S_c$. Then, in step S820, a driving signal $S_d$ is generated according to an input signal $S_{in}$ for switching among multiple states according to the switch signal $S_{sw}$. Lastly, in step S830, a dimming signal $S_{dim}$ is generated according to the driving signal $S_d$ for adjusting the luminance of the LED device. When the driving signal $S_d$ switches from the first state to the second state of multiple states, the dimming signal $S_{dim}$ correspondingly changes, such that the luminance of the LED device is adjusted from a first luminance level to a second luminance level. The dimming signal $S_{dim}$ is adjusted when the input signal $S_{in}$ is adjusted according to the control signal $S_c$, such that the luminance of the LED device is between the first luminance level and a minimum luminance level or between the second luminance level and the minimum luminance level.

According to above embodiments of the present disclosure, different types of LED devices and the dimming system and method thereof are provided. Through the switching of luminance mode among multiple luminance modes, the luminance of the LED device of the present disclosure may be uniformly adjusted. Moreover, the luminance of the LED device may be fine-tuned using a second dimming circuit, such that the luminance may be fine-tuned between a first luminance level and a minimum luminance level or between a second luminance level and the minimum luminance level. Additionally, the dimming system and method of the present disclosure may use the LEDs in place of the conventional light bulbs as the light source under the existing architecture of the lamp base design. Thus, in comparison to the prior art, the dimming system and method of the present disclosure allow the user to adjust the luminance of the LED device more conveniently.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A dimming system for controlling a luminance of a light emitting diode (LED) device, wherein the dimming system comprises:

a signal generating circuit configured to generate a driving signal according to an input signal and switch the driving signal among a plurality of states according to a switch signal; and a first dimming circuit configured to generate a dimming signal according to the driving signal for adjusting the luminance of the LED device, wherein when the driving signal switches from a first state to a second state of the plurality of states, the first dimming circuit correspondingly changes the dimming signal, such that the luminance of the LED device is adjusted from a first luminance level to a second luminance level; and a second dimming circuit configured to adjust the input signal according to a control signal, such that the dimming signal is adjusted correspondingly and the luminance of the LED device is between the first luminance level and a minimum luminance level or between the second luminance level and the minimum luminance level.

2. The dimming system according to claim 1, wherein the signal generating circuit comprises:

a filter circuit configured to generate a first signal according to the input signal;

a voltage generating circuit configured to provide a plurality of driving voltage levels according to the first signal; and a multi-stage switch circuit configured to receive the switch signal and switch among the plurality of states to provide the driving signal level corresponding to one of the plurality of states.

3. The dimming system according to claim 2, wherein a voltage level of the dimming signal is directly or inversely proportional to the luminance of the LED device.

4. The dimming system according to claim 1, wherein the driving signal of the plurality of states corresponds to a plurality of luminance levels of the LED device respectively.

5. The dimming system according to claim 1, wherein the second dimming circuit comprises:

a triode for alternating current (TRIAC) dimming control circuit configured to generate an adjustment AC signal according to an AC signal; and a rectifier circuit configured to rectify the adjustment AC signal and generate the input signal;

wherein when the driving signal is in the first state, the TRIAC dimming control circuit selectively adjusts the adjustment AC signal according to the control signal, such that the luminance of the LED device is between the first luminance level and a minimum luminance level;

wherein when the driving signal is in the second state, the TRIAC dimming control circuit selectively adjusts the adjustment AC signal according to the control signal, such that the luminance of the LED device is between the second luminance level and the minimum luminance level.

6. The dimming system according to claim 5, wherein the TRIAC dimming control circuit further adjusts the adjustment AC signal, such that the luminance of the LED device decreases gradually from the first luminance level or second luminance level to the minimum luminance level.

7. The dimming system according to claim 5, wherein the TRIAC dimming control circuit further adjusts the adjustment AC signal, such that the luminance of the LED device increases gradually from the minimum luminance level to the first luminance level or the second luminance level.

8. The dimming system according to claim 5, wherein when the driving signal switches from the second state to a third state of the plurality of states, the first dimming circuit correspondingly changes the dimming signal, such that the luminance of the LED device is adjusted from the second luminance level to a third luminance level.

9. The dimming system according to claim 1, wherein the LED device comprises a luminance-adjusting switch configured to output the switch signal.

10. The dimming system according to claim 9, wherein the luminance-adjusting switch comprises a chain-type switch or a multi-stage key switch.

11. A light emitting diode (LED) device, comprising:

a lamp base;

at least one LED disposed on the lamp base;

the dimming system according to claim 1 electrically coupled to the at least one LED for controlling the luminance of the LED; and a luminance-adjusting switch electrically coupled to the dimming system and the lamp base for actuating and inputting the switch signal to the dimming system, such that the dimming system switches among the plurality of states to adjust the luminance of the at least one LED.

12. The LED device according to claim 11, wherein the luminance-adjusting switch comprises a chain-type switch or a multi-stage key switch.

13. The LED device according to claim 11, wherein the signal generating circuit comprises:

a filter circuit configured to generate a first signal according to the input signal;

a voltage generating circuit configured to provide a plurality of driving voltage levels according to the first signal; and a multi-stage switch circuit configured to receive the switch signal and switch among the plurality of states to provide the driving signal level corresponding to one of the plurality of states.

14. The LED device according to claim 13, wherein a voltage level of the dimming signal is directly or inversely proportional to the luminance of the LED device.

15. The LED device according to claim 11, wherein the driving signal of the plurality of states corresponds to a plurality of luminance levels of the LED device respectively.

16. The LED device according to claim 11, wherein the second dimming circuit comprises:

a triode for alternating current (TRIAC) dimming control circuit configured to generate an adjustment AC signal according to an AC signal; and a rectifier circuit configured to rectify the adjustment AC signal and generate the input signal;

wherein when the driving signal is in the first state, the TRIAC dimming control circuit selectively adjusts the adjustment AC signal according to the control signal, such that the luminance of the LED device is between the first luminance level and a minimum luminance level;

wherein when the driving signal is in the second state, the TRIAC dimming control circuit selectively adjusts the adjustment AC signal according to the control signal, such that the luminance of the LED device is between the second luminance level and the minimum luminance level.

17. The LED device according to claim 16, wherein the TRIAC dimming control circuit further adjusts the adjustment AC signal, such that the luminance of the LED device decreases gradually from the first luminance level or second luminance level to the minimum luminance level.

18. The LED device according to claim 16, wherein the TRIAC dimming control circuit further adjusts the adjustment AC signal, such that the luminance of the LED device increases gradually from the minimum luminance level to the first luminance level or the second luminance level.

19. The LED device according to claim 16, wherein when the driving signal switches from the second state to a third state of the plurality of states, the first dimming circuit correspondingly changes the dimming signal, such that the luminance of the LED device is adjusted from the second luminance level to a third luminance level.

20. A dimming method of LED device, comprising:

generating an input signal according to a control signal;

generating a driving signal according to the input signal, wherein the driving signal is switched among a plurality of states according to a switch signal; and generating a dimming signal according to the driving signal for adjusting the luminance of the LED;

wherein when the driving signal switches from a first state to a second state of the plurality of states, the dimming signal correspondingly changes, such that the luminance of the LED device is adjusted from a first luminance level to a second luminance level;

wherein the dimming signal is further adjusted when the input signal is adjusted according to the control signal, such that the luminance of the LED device is between the first luminance level and a minimum luminance level or between the second luminance level and the minimum luminance level;

wherein the driving signal of the plurality of states corresponds to a plurality of luminance levels of the LED device respectively.

21. The dimming method according to claim 20, the step of generating the driving signal according to the input signal further comprises:

generating a first signal according to the input signal;

providing a plurality of driving voltage levels according to the first signal; and receiving the switch signal and switching among the plurality of states to provide the driving signal corresponding to one of the plurality of states.

22. The dimming method according to claim 20, further comprising:

generating an adjustment AC signal according to an AC signal; and rectifying the adjustment AC signal to generate the input signal;

wherein when the driving signal is in the first state, the adjustment AC signal is selectively adjusted according to the control signal, such that the luminance of the LED device is between the first luminance level and a minimum luminance level;

wherein when the driving signal is in the second state, the adjustment AC signal is selectively adjusted according to the control signal, such that the luminance of the LED device is between the second luminance level and the minimum luminance level.

23. The dimming method according to claim 22, wherein the step of selectively adjusting the adjustment AC signal according to the control signal comprises:

adjusting the adjustment AC signal, such that the luminance of the LED device decreases gradually from the first luminance level or the second luminance level to the minimum luminance level.

24. The dimming method according to claim 22, wherein the step of selectively adjusting the adjustment AC signal according to the control signal comprises:

adjusting the adjustment AC signal, such that the luminance of the LED device increases gradually from the minimum luminance level to the first luminance level or the second luminance level.

25. The dimming method according to claim 22, wherein when the driving signal switches from the second state to a third state of the plurality of states, the first dimming signal correspondingly changes, such that the luminance of the LED device is adjusted from the second luminance level to a third luminance level.

* * * * *